US009016733B2

(12) United States Patent
Fath

(10) Patent No.: US 9,016,733 B2
(45) Date of Patent: Apr. 28, 2015

(54) FALLING LATCH LOCKING DEVICE

(75) Inventor: Jan Mirko Fath, Georgensgmuend (DE)

(73) Assignee: Fath GmbH, Spalt (DE)

( * ) Notice: Subject to any disclaimer, the term of this patent is extended or adjusted under 35 U.S.C. 154(b) by 307 days.

(21) Appl. No.: 13/457,954

(22) Filed: Apr. 27, 2012

(65) Prior Publication Data

US 2012/0274086 A1 Nov. 1, 2012

(30) Foreign Application Priority Data

Apr. 28, 2011 (DE) ..... 10 2011 018 999

(51) Int. Cl.

| | |
|---|---|
| ***E05C 1/08*** | (2006.01) |
| ***E05B 65/00*** | (2006.01) |
| ***E05B 7/00*** | (2006.01) |
| ***E05B 13/00*** | (2006.01) |
| ***E05C 1/14*** | (2006.01) |
| *E05C 1/00* | (2006.01) |
| *E05B 9/08* | (2006.01) |
| *E05B 15/02* | (2006.01) |

(52) U.S. Cl.

CPC ..... *E05B 65/0007* (2013.01); *E05B 7/00* (2013.01); *E05B 13/002* (2013.01); *E05C 1/14* (2013.01); *E05B 9/08* (2013.01); *E05B 2015/023* (2013.01); *Y10S 292/20* (2013.01); *Y10S 292/47* (2013.01)

(58) Field of Classification Search

USPC ..... 292/163, 169, 173, DIG. 20, DIG. 38, 292/DIG. 47; 70/89, 90

See application file for complete search history.

(56) References Cited

U.S. PATENT DOCUMENTS

| | | | | | |
|---|---|---|---|---|---|
| 1,558,980 | A | * | 10/1925 | Halinka | 292/166 |
| 1,654,221 | A | * | 12/1927 | Kline | 292/37 |
| 2,055,688 | A | * | 9/1936 | Halinka | 292/153 |
| 2,642,300 | A | * | 6/1953 | Pelcin | 292/173 |
| 2,987,908 | A | * | 6/1961 | Pelcin | 70/483 |
| 3,055,204 | A | * | 9/1962 | Pelcin | 70/153 |
| 3,389,932 | A | * | 6/1968 | Pastva, Jr. | 292/173 |
| 3,425,728 | A | * | 2/1969 | Turner | 292/153 |
| 3,449,005 | A | * | 6/1969 | Pastva, Jr. | 292/173 |
| 3,789,550 | A | * | 2/1974 | Seiwert | 49/503 |
| 3,871,198 | A | * | 3/1975 | Miller | 70/489 |
| 4,170,119 | A | * | 10/1979 | Kalis, Jr. | 70/221 |
| 4,420,954 | A | * | 12/1983 | Hieronymi et al. | 70/150 |
| 4,683,736 | A | | 8/1987 | Weinerman et al. | |
| 4,746,152 | A | * | 5/1988 | Willcox | 292/150 |
| 5,263,346 | A | * | 11/1993 | Sato et al. | 70/210 |
| 5,301,989 | A | * | 4/1994 | Dallmann et al. | 292/142 |
| 5,484,178 | A | * | 1/1996 | Sandhu et al. | 292/173 |
| 7,040,125 | B2 | * | 5/2006 | Ciezki et al. | 70/208 |
| 7,063,361 | B1 | * | 6/2006 | Lawrence | 292/241 |
| 7,118,142 | B2 | * | 10/2006 | Xu | 292/139 |
| 7,699,365 | B2 | * | 4/2010 | Liang et al. | 292/240 |

(Continued)

FOREIGN PATENT DOCUMENTS

| | | | |
|---|---|---|---|
| DE | 102 46 441 | A1 | 4/2004 |
| DE | 20 2007 009 513 | U1 | 9/2007 |

(Continued)

*Primary Examiner* — Carlos Lugo

(74) *Attorney, Agent, or Firm* — Lucas & Mercanti, LLP

(57) ABSTRACT

Falling latch locking device having a first locking device casing that includes a handle, a closing element and a lock, and having a second locking device casing that includes a cut-out for receiving the closing element in the closed state, wherein the lock comprises a stop that can be moved by locking and unlocking the lock and in the locked state the stop blocks the opening of the handle.

6 Claims, 4 Drawing Sheets

(56) References Cited

U.S. PATENT DOCUMENTS

| | | | | |
|---|---|---|---|---|
| 7,731,251 | B2 * | 6/2010 | Ye | 292/163 |
| 8,182,001 | B2 * | 5/2012 | Tremble et al. | 292/32 |
| 8,333,413 | B2 * | 12/2012 | Bourgoin et al. | 292/164 |
| 8,414,039 | B2 * | 4/2013 | Liang et al. | 292/240 |
| 2001/0049950 | A1 | 12/2001 | Finch | |
| 2004/0074267 | A1 | 4/2004 | Linares | |
| 2004/0201227 | A1 * | 10/2004 | Smith | 292/241 |
| 2006/0255596 | A1 * | 11/2006 | Yong | 292/173 |
| 2010/0078946 | A1 * | 4/2010 | Sun | 292/336.3 |

FOREIGN PATENT DOCUMENTS

| | | | |
|---|---|---|---|
| DE | 10 2009 32 025 | A1 | 1/2011 |
| EP | 502825 | * | 9/1992 |
| EP | 566541 | * | 10/1993 |
| EP | 918123 | * | 5/1999 |
| GB | 2168420 | * | 6/1986 |

* cited by examiner

FALLING LATCH LOCKING DEVICE

This application claims the priority of DE 10 2011 018 99.8 filed Apr. 28, 2011, Which is incorporated by reference herein.

The invention relates to a falling latch locking device having a first locking device casing that comprises a handle, a closing element and a lock, and having a second locking device casing that comprises a cut-out for receiving the closing element in the closed state.

Falling latch locking devices are used for example in windows, doors or flaps to hold said items in the closed position. A locking device casing of the falling latch locking device is arranged on a fixed frame or the like, the other locking device casing is arranged on a movable, generally pivotable frame or on a door or window wing. The locking device casing that receives the closing element in the locked state comprises a catchplate which is engaged from the rear, whereby the closing element is held in the closed state. The moveable frame, the window wing or door wing in this state can only be opened once the closing element has been drawn back against a resilient force. A "protruding component" that locks the closing element in the locked state performs the locking procedure in the closed state.

However, in some cases it is desirable that in the locked state an "emergency unlocking procedure" is possible, in order for example to be able to open the falling latch locking device from the rear side.

The object of the invention is therefore to provide a falling latch locking device that renders it possible on the one hand to have a reliable locking procedure and on the other hand to be able to perform an emergency opening procedure.

In order to achieve this object, it is provided in accordance with the invention in the case of a falling latch locking device of the type mentioned in the introduction, that the lock comprises a stop that can be moved by locking and unlocking the lock and in the locked state said stop blocks the opening of the handle.

In contrast to known falling latch locking devices, the handle is blocked in accordance with the invention and not the closing element. In this manner, a reliable locking procedure is achieved, as the handle that moves to perform the opening procedure cannot be raised. On the other hand, an emergency opening procedure is possible, in that the closing element can be urged back against the resilient force at least by using a suitable opening tool, in order to open the falling latch locking device.

In accordance with a further embodiment of the falling latch locking device in accordance with the invention, the lock can be embodied as a cylinder lock. Preferably the stop is arranged on an inner-lying end section of the cylinder lock, so that the said stop is rotated about the longitudinal axis of the cylinder when opening or closing the lock.

A particularly reliable functioning of the falling latch locking device is achieved when the lock is in the locked state if the stop blocks a section of the handle that is concealed by the first locking device casing. The closed state of the lock is then not immediately evident from the outside.

In order to provide greater protection against undesired attempts to open the lock, it can be provided that in the case of the falling latch locking device in accordance with the invention the first locking device casing and/or the second locking device casing can be fastened to the frame or the like by means of fastening means, in particular by means of screws and nuts, wherein the fastening means are arranged under covers that cannot be removed in the locked state. These covers can be embodied and arranged in such a manner that they are only accessible in the open state, i.e. when the handle has been rotated or pivoted, so that they can be removed. Once the covers have been removed, they reveal the screw or nut used as the fastening means. However, in the closed state, i.e. when the handle has not been raised or pivoted upwards and the cylinder lock is locked, the fastening means are not accessible, thus providing greater protection.

In a further embodiment of the invention it can be provided that the falling latch locking device comprises at least one signaling means, in particular an illuminating means, in particular an light emitting diode, that indicate(s) status information. For example, the illuminating means can indicate the open state, which can be indicated by a light emitting diode that is illuminating or not illuminating. Likewise, two or more illuminating means of this type can be provided that comprise identical or different colors, so that a first color can indicate a closed state and a second color can indicate an open state of the falling latch lock device. Furthermore, for example, an error can be indicated in this manner.

It is also within the scope of the invention that in at least one locking device casing a sensor for sensing an open or closed state of the falling latch locking device and/or of the closing element is arranged. This sensor can possibly cooperate with the signaling means or illuminating means mentioned, so that an open or closed state sensed by the sensor is indicated by the signaling means. Alternatively or in addition, it can be provided that a sensor signal generated by the sensor is transmitted to a remote component, possibly a control device, so that it can be evaluated by the control device. An optional further embodiment of the invention provides that the falling latch locking device comprises a radio module that is embodied for the wireless transmission of information to a receiver, in particular status information. In the case of this variant, it is not necessary to provide costly and disturbing cabling of one or a plurality of sensors, the sensor signals are transmitted instead in a wireless manner to a receiver for further processing.

Further advantages and details of the invention are described by means of an exemplary embodiment with reference to the drawings. The drawings are schematic illustrations, in which.

Figure 1:
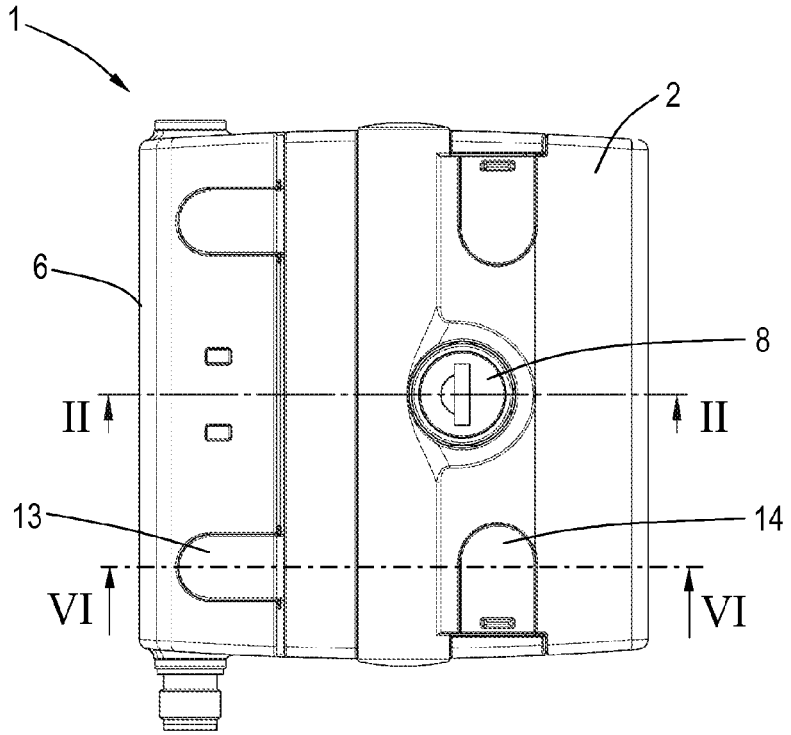
FIG. 1 shows a plan view of a falling latch locking device in accordance with the invention where the lock is in the locked state.
Figure 2:
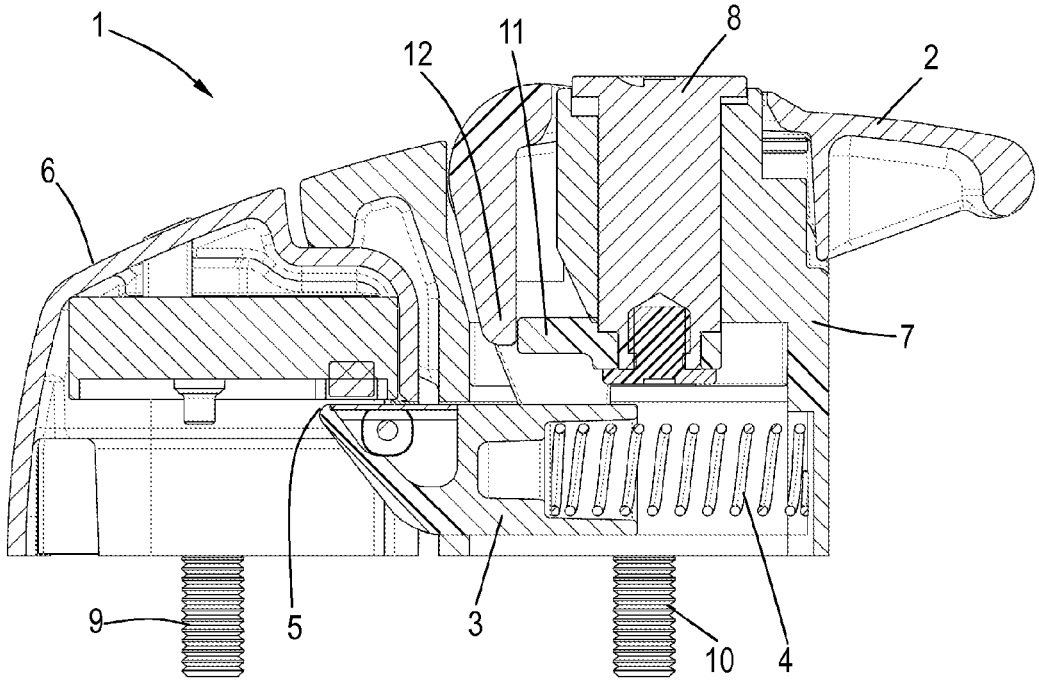
FIG. 2 shows a sectional side view of the falling latch locking device along the line II-II shown in FIG. 1.

The falling latch locking device 1 illustrated in FIG. 1 in a plan view and in FIG. 2 in a sectional side view comprises a handle 2, a closing element 3 that is influenced by a compression spring 4 that moves the closing element 3 into a catchplate 5, which can be engaged from the rear, of a locking device casing 6. The handle 2 is arranged in a first locking device casing 7 that in addition to the closing element 3 comprises a cylinder lock 8. The falling latch locking device 1 is illustrated in FIGS. 1 and 2 in the locked state.

The locking device casing 6 is arranged by means of fastening means 9 on a fixed frame, the locking device casing 6 is attached to a pivotable frame by means of fastening means 10.

The cylinder lock 8 comprises a stop 11 that is arranged at right angles with respect to the longitudinal axis of the cylinder lock 8 and can be rotated by 90° or 180° as the cylinder lock 8 is opened and closed by means of a key. The falling latch locking device 1 is locked in the position illustrated in FIG. 2. The stop 11 blocks an inner-lying end section 12 of the handle 2 so that the said handle cannot be raised or pivoted and as a consequence the opening procedure cannot be performed.

The fastening means 9, 10 that attach the first locking device casing 7 or the second locking device casing 6 respectively to a frame or the like are located under covers 13, 14 that cannot be removed in the locked position illustrated in FIGS. 1 and 2. It is only possible to remove the covers and thus dismantle the components of the falling latch locking device 1 in the open, unlocked position.

In order still to be able to perform an opening procedure in an emergency situation, the closing element 3 can be urged back against the force of the compression spring using a suitable tool, until said closing element is no longer located in the catchplate 5, which can be engaged from the rear, of the locking device casing 6, following which the falling latch locking device 1 can be swung open even if the cylinder lock 8 by means of its stop 11 blocks the end section 12 of the handle. It is possible to perform an emergency unlocking procedure in the case of the falling latch locking device 1 as it is the handle 2 that is locked in the locked state and not the closing element 3.

Figure 3:
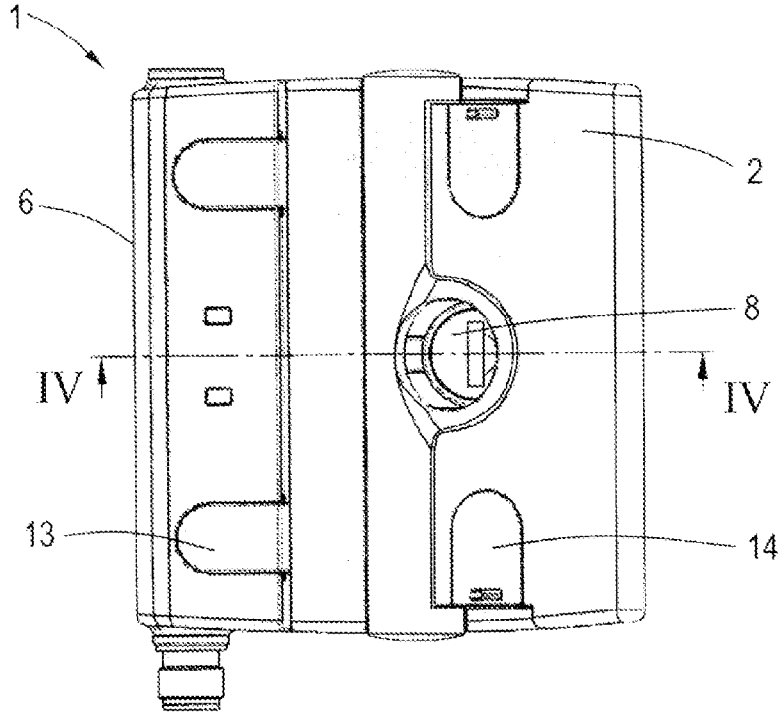
FIG. 3 shows a plan view of the falling latch locking device where the lock is not in the locked state.
Figure 4:
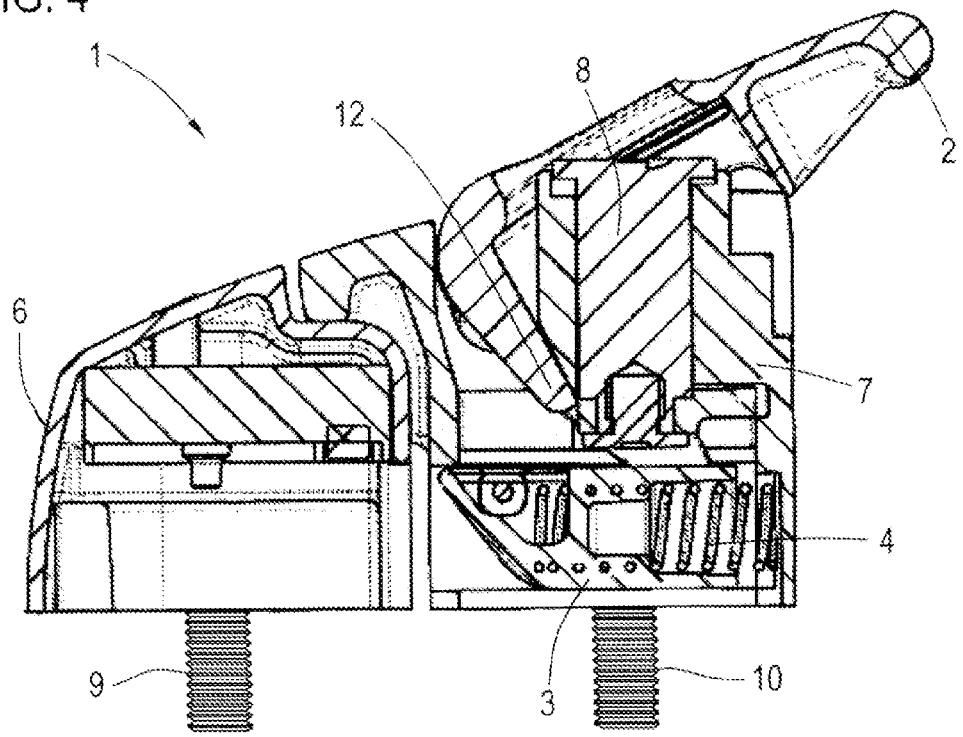
FIG. 4 shows a sectional side view of the falling latch locking device along the line IV-IV shown in FIG. 3.

FIGS. 3 and 4 illustrate the falling latch locking device 1 in a plan view and a sectional side view respectively in an unlocked position. In the unlocked state, the handle 2 is pivoted upwards, as a consequence of which the closing element 3 is drawn back by the handle 2, i.e. it is located in FIG. 4 on the right, so that it no longer blocks the catchplate 5, which can be engaged from the rear, of the locking device casing 6. In this position the handle 2 with the entire locking device casing 7 can be raised, as a consequence of which the falling latch locking device 1 is opened. In the open position illustrated in FIG. 4 the closing element 3 is located on the right and in the locked position illustrated in FIG. 2, whilst the handle 2 is locked in place, the closing element 3 is located on the left.

Figure 5:
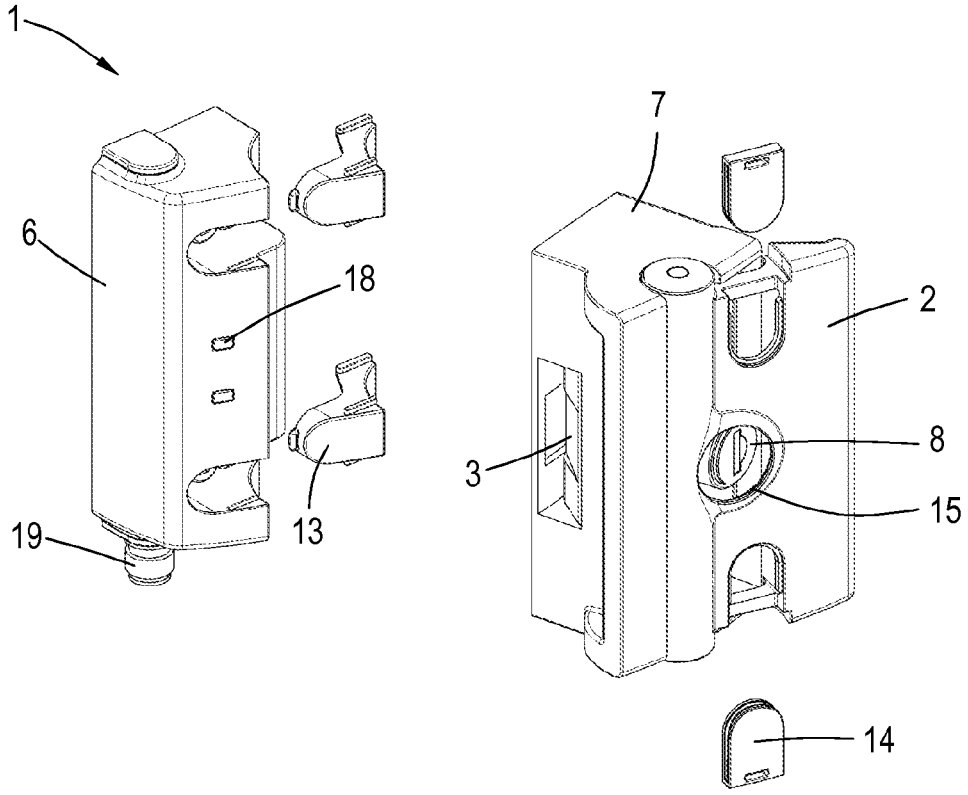
FIG. 5 shows perspective views of the locking device casing of the falling latch locking device where the covers have been removed.
Figure 6:
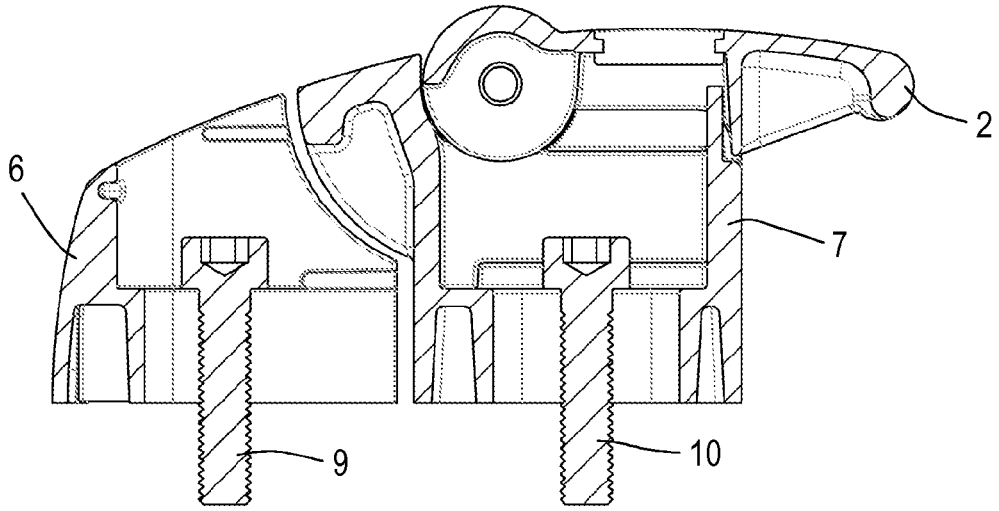
FIG. 6 shows a sectional view of the falling latch locking device illustrated in FIG. 1 along the line VI-VI.

FIG. 5 illustrates a perspective view of the falling latch locking device 1 where the covers have been removed. FIG. 5 illustrates the first locking device casing 7 and the second locking device casing 6 where the covers 13, 14 have been removed. FIG. 6 illustrates a sectional view along the line VI-VI shown in FIG. 1, i.e. transverse with respect to the fastening means 9, 10. Once the covers 13, 14 have been removed, the fastening means 9, 10 are accessible through openings in the locking device casing 6, 7, so that it is possible to perform an assembling or dismantling procedure. It is evident from FIG. 5 that the cylinder lock 8 is arranged on the locking device casing 7. The handle 2 comprises a cut-out 15 which is penetrated in the closed state by the upper end of the cylinder lock 8.

Figure 7:
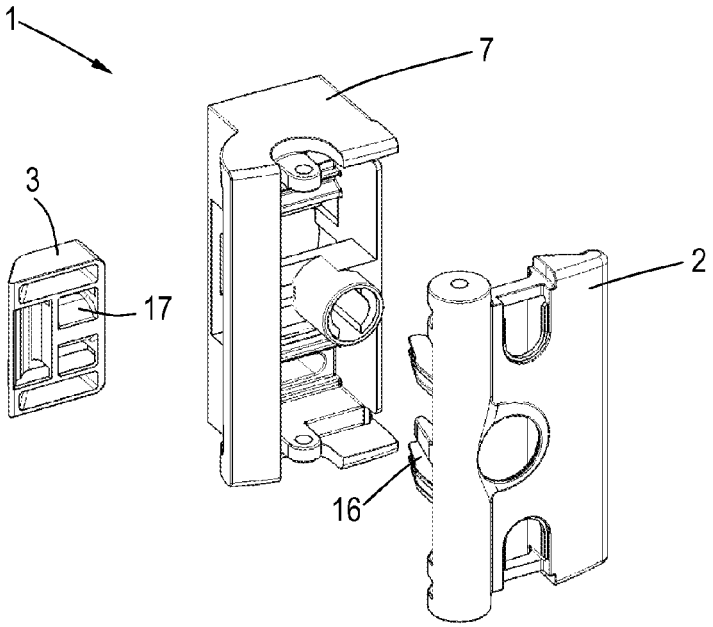
FIG. 7 shows a perspective view of the essential components of the falling latch locking device.

If the falling latch locking device is opened by means of moving the handle 2, protrusions 16 of the handle 2 engage in corresponding cut-outs 17 of the closing element 3 that is consequently drawn back into the locking device casing 7 and as a consequence the locking arrangement is released. The construction of these components is most evident in FIG. 7, which illustrates the essential components of the falling latch locking device 1 in a perspective view.

It is evident in FIG. 5 that the locking device casing 6 comprises on its outer face illuminating means embodied as light emitting diodes 18; these are however optional. The light emitting diodes indicate an open state or a dosed or locked state of the falling latch locking device 1. It is possible to arrange a sensor in the locking device casing 6, which sensor senses the open state of the falling latch locking device 1 and transmits said information to a control device or the like. The locking device casing 6 comprises for this purpose a sealed cable end 19 on one end for connecting corresponding lines.

A radio module (not illustrated) can be arranged as an alternative or in addition inside the locking device casing 6, the said radio module being embodied for the wireless transmission of information to a receiver, in particular status information relating to the falling latch locking device 1. In this way, the falling latch locking device 1 can be a component of an automatic production line or the like.

Figure 8:
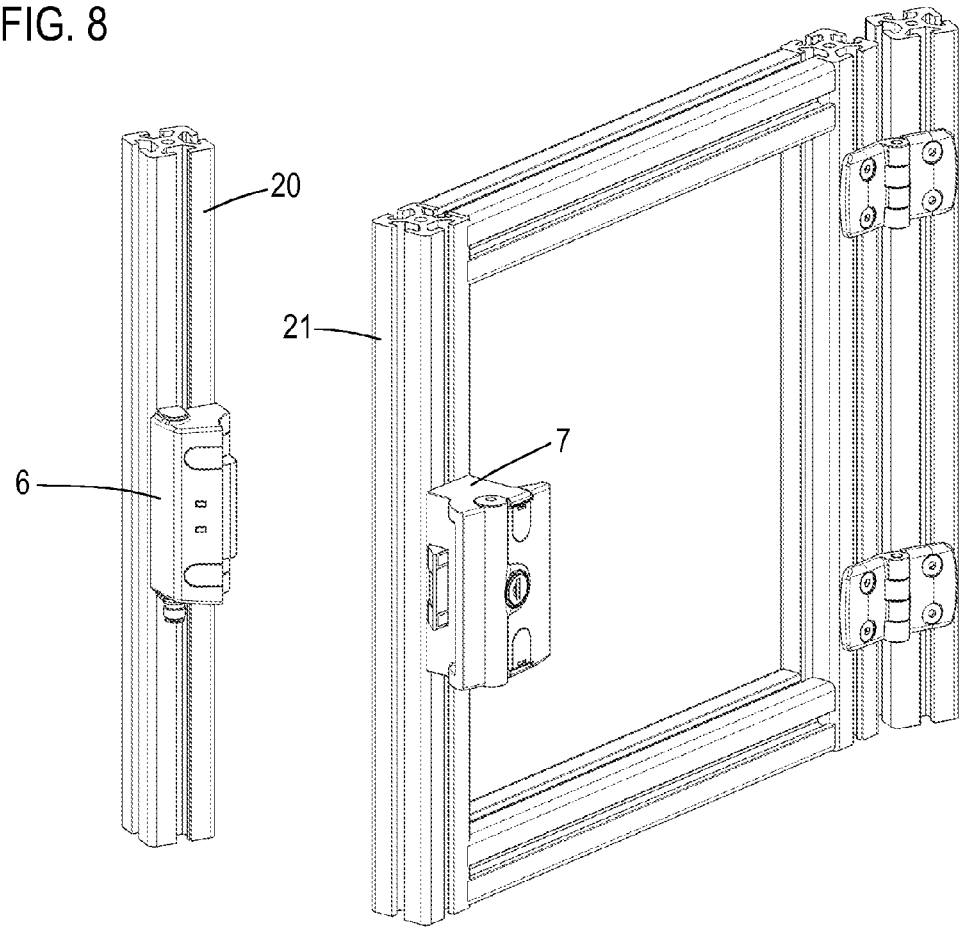
FIG. 8 shows a perspective view of a falling latch locking device mounted on a frame.

FIG. 8 illustrates the falling latch locking device 1 comprising the fixed locking device casing 6 and the moveable locking device casing 7, which are attached in each case to a frame profile 20, 21. The fixed frame profile 20 is a component of a manufacturing cell, which is closed by the frame profile 21 that forms a flap, a window or a door. The entrance to the manufacturing cell is consequently opened or closed by the falling latch locking device 1. Any undesired dismantling of the falling latch locking device 1 is not possible in the locked state as the fastening means 9, 10 are concealed by the covers 13, 14. However, the falling latch locking device 1 in the locked state can be opened by urging back the closing element from the rearside or the underside of the locking device casing 7 to enable an emergency unlocking procedure.

The invention claimed is:

1. Falling latch locking device comprising:

a first locking device casing with a handle, a closing element and a lock;

a second locking device casing with a cut-out for receiving the closing element in a closing state;

the lock having a stop that moves between a locked and an unlocked state and in the locked state said stop blocks the handle from moving to an open state; and the first locking device casing is fastenable to a first frame member by a first fastening means accessible though openings on the handle and arranged under first covers mounted on the handle;

the second locking device casing is fastenable to a second frame by a second fastening means accessible through openings on the second locking device casing and arranged under second covers;

wherein the first locking device casing and the second locking device casing are configured and arranged so that in the closed state and in the locked state the first locking device casing and the second locking device casing prevent removal of the first and second covers.

2. Falling latch locking device according to claim 1, wherein the lock is a cylinder lock.

3. Falling latch locking device according to claim 1, wherein when the lock is in the locked state, the stop blocks a section of the handle that is concealed by the first locking device casing.

4. Falling latch locking device according to claim 1, further comprising at least one signaling means, that indicate(s) status information.

5. Falling latch locking device according to claim 1, further comprising a sensor in at least one of the casings, for sensing an open or closed state of the falling latch lock and/or of the closing element.

6. Falling latch locking device according to claim 1, further comprising a radio module for the wireless transmission of information to a receiver.

* * * * *